US012460391B2

(12) United States Patent
Moriya et al.

(10) Patent No.: US 12,460,391 B2
(45) Date of Patent: Nov. 4, 2025

(54) AUTOMATIC SENSOR IDENTIFICATION SYSTEM AND IDENTIFICATION METHOD IN CONSTRUCTION MACHINE

(71) Applicant: Caterpillar SARL, Geneva (CH)

(72) Inventors: Naoyuki Moriya, Akashi (JP); Keisuke Shirani, Akashi (JP)

(73) Assignee: Caterpillar SARL, Geneva (CH)

( * ) Notice: Subject to any disclaimer, the term of this patent is extended or adjusted under 35 U.S.C. 154(b) by 432 days.

(21) Appl. No.: 17/618,992

(22) PCT Filed: Jun. 12, 2020

(86) PCT No.: PCT/EP2020/025279
§ 371 (c)(1),
(2) Date: Dec. 14, 2021

(87) PCT Pub. No.: WO2020/249264
PCT Pub. Date: Dec. 17, 2020

(65) Prior Publication Data

US 2022/0298757 A1 Sep. 22, 2022

(30) Foreign Application Priority Data

Jun. 14, 2019 (JP) ..... 2019-110906

(51) Int. Cl.
*E02F 9/26* (2006.01)
*E02F 9/22* (2006.01)

(52) U.S. Cl.
CPC ..... *E02F 9/264* (2013.01); *E02F 9/2203* (2013.01); *E02F 9/2285* (2013.01); *E02F 9/2292* (2013.01)

(58) Field of Classification Search
CPC ..... E02F 9/264; E02F 9/2203; E02F 9/2285; E02F 9/2292; E02F 9/2058
(Continued)

(56) References Cited

U.S. PATENT DOCUMENTS 5,471,312 A * 11/1995 Watanabe ..... B25J 9/1692 347/256
2009/0228189 A1 9/2009 Dumitru-Mircea et al.
(Continued)

FOREIGN PATENT DOCUMENTS

CN 106815063 A * 6/2017
CN 107923150 4/2018
(Continued)

OTHER PUBLICATIONS

International Search Report related to Application No. PCT/EP2020/025279; reported on Sep. 25, 2020.
(Continued)

*Primary Examiner* — Anne Marie Antonucci
*Assistant Examiner* — Shien Ming Chou

(57) ABSTRACT

To reduce the burden of an operator when performing a task for identifying which posture information detection sensor is mounted on which front member in a construction machine where the posture information detection sensors are mounted on multiple front members constituting a working machine. An automatic identification system is provided which has an identification task start button for being operated to start an identification task, a front member control means for outputting a control instruction for driving and stopping multiple front members sequentially, individually, and automatically, and a sensor identification means for identifying IMU mounted on each front member based on changes of a detection value of IMU as said each front member is driven by the front member control means.

4 Claims, 4 Drawing Sheets

(58) Field of Classification Search
USPC ..... 701/34
See application file for complete search history.

(56) References Cited

U.S. PATENT DOCUMENTS

| | | | | |
|---|---|---|---|---|
| 2009/0259373 | A1 | 10/2009 | Nichols et al. | |
| 2013/0158789 | A1 | 6/2013 | Seki | |
| 2019/0033844 | A1* | 1/2019 | Acharya | G06F 11/3495 |
| 2022/0074168 | A1* | 3/2022 | Yamada | E02F 9/123 |

FOREIGN PATENT DOCUMENTS

| | | | | |
|---|---|---|---|---|
| CN | 109281346 | | | 1/2019 |
| JP | 2002115272 | A | * | 4/2002 |
| JP | 2006209594 | A | * | 8/2006 |
| JP | 2019027062 | A | * | 2/2019 |
| JP | 2019049103 | A | | 3/2019 |
| WO | 2018180115 | A1 | | 10/2018 |

OTHER PUBLICATIONS

Japanese Patent Office Action for JP Patent Appln. No. 2019-110906, mailed Feb. 2, 2023 (3 pgs).

* cited by examiner

AUTOMATIC SENSOR IDENTIFICATION SYSTEM AND IDENTIFICATION METHOD IN CONSTRUCTION MACHINE

CROSS-REFERENCE TO RELATED APPLICATION

This Application is a 35 USC § 371 US National Stage filing of International Application No. PCT/EP2020/025279 filed on Jun. 12, 2020 which claims priority under the Paris Convention to Japanese Patent Application No. 2019-110906 filed on Jun. 14, 2019.

TECHNICAL FIELD

The present invention relates to a technical field for an automatic sensor identification system and identification method in construction machines such as a hydraulic excavator.

BACKGROUND ART

In general, some construction machines such as a hydraulic excavator have an articulated working machine configured by rotatably connecting multiple front members. Moreover, in the construction machine having such articulated working machine, it is well known that each posture information detection sensor (IMU (Inertial Measurement Unit), for example) is mounted on each of multiple front members constituting the working machine (boom, stick, bucket, and others, constituting front working machine, for example in hydraulic excavator) for detecting posture information of each front member, a detection signal is input into a control unit from each posture information detection sensor via an onboard network, a posture of each front member is calculated in the control unit, and the calculated posture of front members is displayed on a display unit such as a monitor and made use of for movable range restriction and automatic control of the working machine.

Now, when configuring the working machine to mount multiple posture information detection sensors such as said IMU respectively on multiple front members, input the detection signal from the posture information detection sensors into the control unit via the onboard network, and calculate the posture of front members in the control unit, and if those posture information detection sensors are used which have a common specification mountable on various front members, in order to make it possible to identify which detection signal input denotes the posture information of which front member, it is necessary to identify which one of multiple posture information detection sensors is respectively mounted on which front member. Here, it takes some time and labor to sequentially mount the posture information detection sensors one by one on the front members and perform their identification, because it must be repeated as much time as the number of posture information detection sensors to install and identify the posture information detection sensors. Meanwhile, an identification task mentioned above will be eliminated by using the posture information detection sensor with dedicated identification information for each front member, but the posture information detection sensors cannot be standardized, it takes labor and cost to manage their parts, and wrong posture information detection sensor may be mounted on the front member when mounting each sensor on the front member.

Therefore, a technology is proposed heretofore which, based on a motion of front member obtained as a result of an operation driving one of multiple front members alone and an existence of a change of the posture information detected in the posture information detection sensor, provides a mounted point determination unit to determine a mounted point of posture information detection sensor mounted on a front member corresponding to an operation signal detected in an operation signal detection unit (see PTL 1, for example). This technology enables you to identify which posture information detection sensor is mounted on which front member while mounting the multiple posture information detection sensors on respective front members, so that posture information detection sensors can be standardized and wrong mounting of posture information detection sensor can be eliminated.

PRIOR ART LITERATURES

Patent Literatures

[PATENT LITERATURE 1] Japanese Unexamined Patent Application Publication No. 2019-27062

SUMMARY OF THE INVENTION

Problems to be Solved by the Invention

However, in PTL 1 mentioned above, when identifying which posture information detection sensor is mounted on which front member, an operator is supposed to perform an operation to sequentially drive one of multiple front members alone. In addition, since the identification of posture information detection sensors mounted on front members of the working machine is performed in order of distal to proximal, similar to a first embodiment of PTL 1, when the identification goes on in parallel with common tasks such as a digging in hydraulic excavator, it may take time to complete the identification because multiple front members are often driven at a same time in the common tasks such as the digging, and there arises a problem that the posture information of front members cannot be obtained until their identification is completed. On the other hand, in a third embodiment of PTL 1, a mode is configured to perform the identification task and a display is shown to encourage the operator to operate a front member related to the identification in the mode, but the operator has to perform the operation to sequentially drive one of multiple front members individually even though its operating procedures are shown, and it takes labor and the task is a burden of the operator. This is a challenge to be solved by this invention.

Means for Solving the Problem

The present invention is created to solve these challenges in consideration of current condition above. The invention of claim 1 is an automatic sensor identification system in a construction machine, wherein the construction machine has: an articulated working machine installed on a vehicle body and configured by rotatably connecting multiple front members, a front member driving means for driving each of said multiple front members, multiple posture information detection sensors mounted on said multiple front members respectively for detecting posture information of said front members, and a control unit calculating a posture of front members based on detection signals from the posture information detection sensors; and wherein, when providing the automatic identification system for performing an identification task to identify which one of said multiple posture information detection sensors is mounted respectively on which front member, the automatic identification system has: a task starting means operated for starting the identification task, a front member control means for outputting a control instruction to said front member driving means to drive and stop said multiple front members sequentially, individually, and automatically, and a sensor identification means for identifying the posture information detection sensor mounted on each front member based on changes of a detection value from the posture information detection sensor as said each front member is driven by the front member control means.

The invention of claim 2 is the automatic sensor identification system in the construction machine of claim 1, wherein the automatic identification system has a mode selection means for selecting a mode to start up the automatic identification system The invention of claim 3 is the automatic sensor identification system in the construction machine of claim 1 or 2, wherein automatic drive and stop processes of the multiple front members by the front member control means go on only when a task progression means is operating.

The invention of claim 4 is the automatic sensor identification system in the construction machine of claim 3, wherein the task starting means is also used as the task progression means.

The invention is an automatic sensor identification method in a construction machine to identify which one of multiple posture information detection sensors is mounted respectively on which front member, wherein the construction machine has: an articulated working machine installed on a vehicle body and configured by rotatably connecting multiple front members, a front member driving means for driving each of said multiple front members, the multiple posture information detection sensors mounted on said multiple front members respectively for detecting posture information of said front members, and a control unit calculating a posture of the front members based on detection signals from the posture information detection sensors; and wherein the identification method comprises: operating a task starting means for starting an identification task, outputting the control instruction from a front member control means to said front member driving means to drive and stop the multiple front members sequentially, individually, and automatically, and identifying the posture information detection sensor mounted on each front member based on changes of a detection value from the posture information detection sensor as said each front member is driven by the front member control means.

Favorable Effects of the Invention

According to the invention, the identification task of posture information detection sensor is performed automatically only when the operator operates the task starting means, so that a lot of trouble can be eliminated, the operator's burden can be reduced, and an identification error can be avoided due to a mis-operation of operator.

According to the invention of claim 2, the automatic identification system is not started up when a mode is not selected, so that unintended startup of automatic identification task can be avoided due to a mis-operation of the task starting means.

According to the invention of claim 3, the operator can be aware of drive and stop processes of front members even if front members are automatically driven and stopped, and when the operator stops the operation of task progression means, automatic drive and stop processes of front members are stopped, thereby responding to unexpected incident.

According to the invention of claim 4, the members can be used for diverse purposes and the operator can successively perform a startup and progression of identification task with one operation means, being excellent in operability.

DETAILED DESCRIPTION OF THE INVENTION

Figure 1:
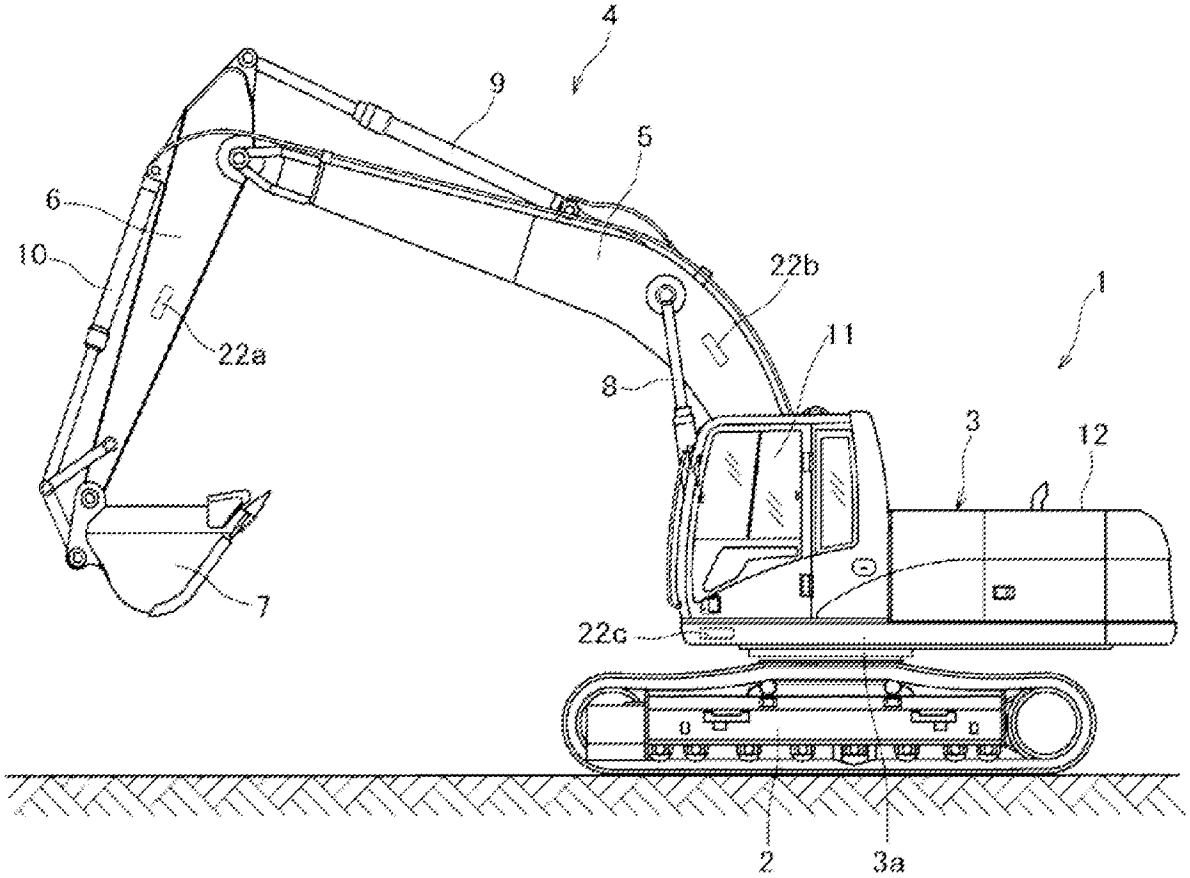
FIG. 1 is a side view of a hydraulic excavator.

Now, an explanation is provided below about an embodiment of the present invention based on drawings. In the FIG. 1, a symbol 1 indicates hydraulic excavator which is an example of a construction machine, wherein the hydraulic excavator 1 is composed of a crawler type lower traveling body 2, an upper swiveling body 3 swivelably supported by the lower traveling body 2, and an articulated front working machine 4 installed on the upper swiveling body 3, and others; the front working machine 4 is configured to have a boom 5 whose base end part is rotatably supported with respect to the upper swiveling body 3 and which is vertically driven with respect to the supporting part as a fulcrum, a stick 6 which is rotatably supported at an end part of the boom 5 and which is driven in-side (direction coming close to upper swiveling body 3) and out-side (direction going away from upper swiveling body 3) with respect to the supporting part as a fulcrum, a bucket 7 rotatably supported at the end part of the stick 6, and others; wherein the hydraulic excavator 1 comprises a traveling motor (not shown) for running the lower traveling body 2, a swiveling motor (not shown) for swiveling the upper swiveling body 3, and various hydraulic actuators such as a boom cylinder 8, stick cylinder 9, and bucket cylinder 10 for driving the boom 5, stick 6, and bucket 7 respectively. Note that, in this embodiment, the upper swiveling body 3 is equivalent to the vehicle body of this invention, front working machine 4 is equivalent to articulated working machine of this invention, and boom 5 and stick 6 is equivalent to front members of this invention.

A cab 11 as an operating room of operator and engine room 12 storing various types of equipment such as an engine are mounted on the upper swiveling body 3, and a hydraulic system (not shown in FIG. 1) for driving various hydraulic actuators comprised in the hydraulic excavator 1 is installed in the upper swiveling body 3. An operator's seat (not shown) for operator's sitting, various manipulators (not shown) for traveling, swiveling, operating the boom, stick, and bucket, and others, and a monitor unit 13 (not shown in FIG. 1) for various displays and settings are arranged in the cab 11.

Figure 2:
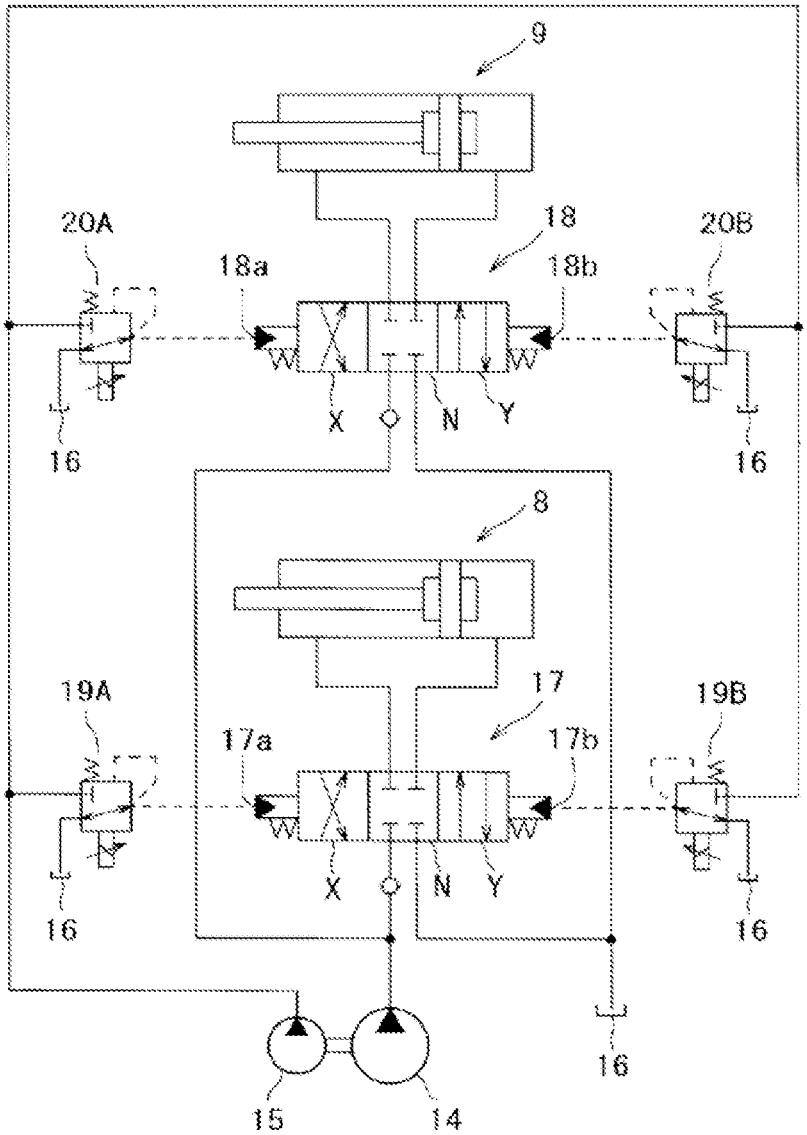
FIG. 2 is a schematic hydraulic circuit diagram of boom cylinder and stick cylinders.

Here, an explanation will be given roughly to hydraulic control of the boom cylinder 8 and stick cylinder 9 according to FIG. 2. In FIG. 2, the symbol 14 is a hydraulic pump as a hydraulic supply source to boom cylinder 8 and stick cylinder 9, the symbol 15 is a pilot pump as a pilot pressure supply source, the symbol 16 is an oil tank, the symbols 17, 18 are boom and stick control valves for controlling feeding and discharging of oil respectively to and from the boom cylinder 8 and stick cylinder 9. The boom control valve 17 is a spool valve having pilot ports 17*a*, 17*b* for extended and contracted sides. The control valve is located at neutral position N where oil is neither fed to nor discharged from the boom cylinder 8 when the pilot pressure is not input into both pilot ports 17*a*, 17*b*; and when the pilot pressure is input into the pilot port 17*a* or 17*b* for extended or contracted side, the control valve is switched to extended side operating position X or contracted side operating position Y for controlling feeding and discharging of oil to and from the boom cylinder 8, so that the boom cylinder 8 is extended or contracted to drive the boom 5 vertically. The stick control valve 18 is similarly configured to the boom control valve 17, and has extended side and contracted side pilot ports 18*a*, 18*b*. When the pilot pressure is input into the extended side or contracted side pilot port 18*a* or 18*b*, the stick control valve is switched to extended side operating position X or contracted side operating position Y for controlling feeding and discharging of oil to and from the stick cylinder 9, so that the stick cylinder 9 is extended or contracted to drive the stick 6 in-side or out-side. Also, the symbols 19A, 19B are proportional solenoid valves for boom extended side and contracted side, the symbols 20A, 20B are proportional solenoid valves for stick extended side and contracted side. These proportional solenoid valves 19A, 19B, 20A, and 20B for boom/stick extended side and contracted side are configured to output the pilot pressure to extended side and contracted side pilot ports 17*a*, 17*b*, 18*a*, 18*b* respectively of the boom and stick control valves 17, 18 based on the control instruction from a controller 21 mentioned later. The controller 21 is configured to receive a detection signal input from a manipulator detection means (not shown) which electrically detects the operation of boom and stick manipulators (neither shown) and output the control instruction of pilot pressure output to the proportional solenoid valves 19A, 19B, 20A, and 20B for the boom/stick extended side and contracted side based on the detection signal to extend and contract the boom and stick cylinder 8, 9, so that the boom 5 and stick 6 are driven depending on the operation of the boom and stick manipulators; but the controller 21 mentioned later is, during an execution of automatic identification task, further configured to output the control instruction to the proportional solenoid valves 19A, 20A for boom/stick extended side to drive the boom 5 and stick 6 while the boom and stick manipulators are not operated. Note that, in this embodiment, the boom cylinder 8, boom control valve 17, proportional solenoid valves 19A, 19B for boom extended side and contracted side are boom driving means for driving the boom 5; the stick cylinder 9, stick control valve 18, proportional solenoid valves 20A, 20B for stick extended side and contracted side are stick driving means for driving the stick 6; and these boom and stick driving means are equivalent to front member driving means of this invention.

Meanwhile, the symbols 22*a* to 22*c* are IMU (Inertial Measurement Unit) measuring angular velocity and acceleration. These IMUs 22*a* to 22*c* are equivalent to posture information detection sensors of this invention; but in this embodiment, as shown in FIG. 1, these IMUs are mounted on the stick 6, boom 5, and swiveling frame 3*a* respectively constituting a mount of upper swiveling body 3. Also, these IMUs 22*a* to 22*c* are configured to detect information regarding each posture of the stick 6, boom 5, and upper swiveling body 3, output their detection signal to the controller 21 (equivalent to the control unit of this invention) via the onboard network 23 such as a CAN communication. Respective IMUs 22*a* to 22*c* have individual identification number, and it is configured to be able to identify which detection signal input into the controller 21 comes from which IMU 22*a*, 22*b*, or 22*c* by outputting detection information added with the individual identification number, but identification information dedicated for mounting member (in this embodiment, stick 6, boom 5, or upper swiveling body 3 mounting either one of IMUs 22*a* to 22*c*; from now on, the stick 6, boom 5, or upper swiveling body 3 may be referred to as mounting members 6, 5, and 3) is not appended in advance, so the controller 21 cannot identify which IMU 22 is mounted on which one of mounting members 6, 5, and 3 until the identification task is completed by automatic identification system mentioned later. Note that, in this embodiment, those IMUs 22*a* to 22*c* whose identification task is not completed may be described as IMU 22 as a whole.

Then, an explanation will be given about a control related to both the IMUs 22*a* to 22*c* and automatic identification system of all controls performed by the controller 21 based on the structure block diagram in FIG. 3 and the flow chart diagram in FIG. 4.

Figure 3:
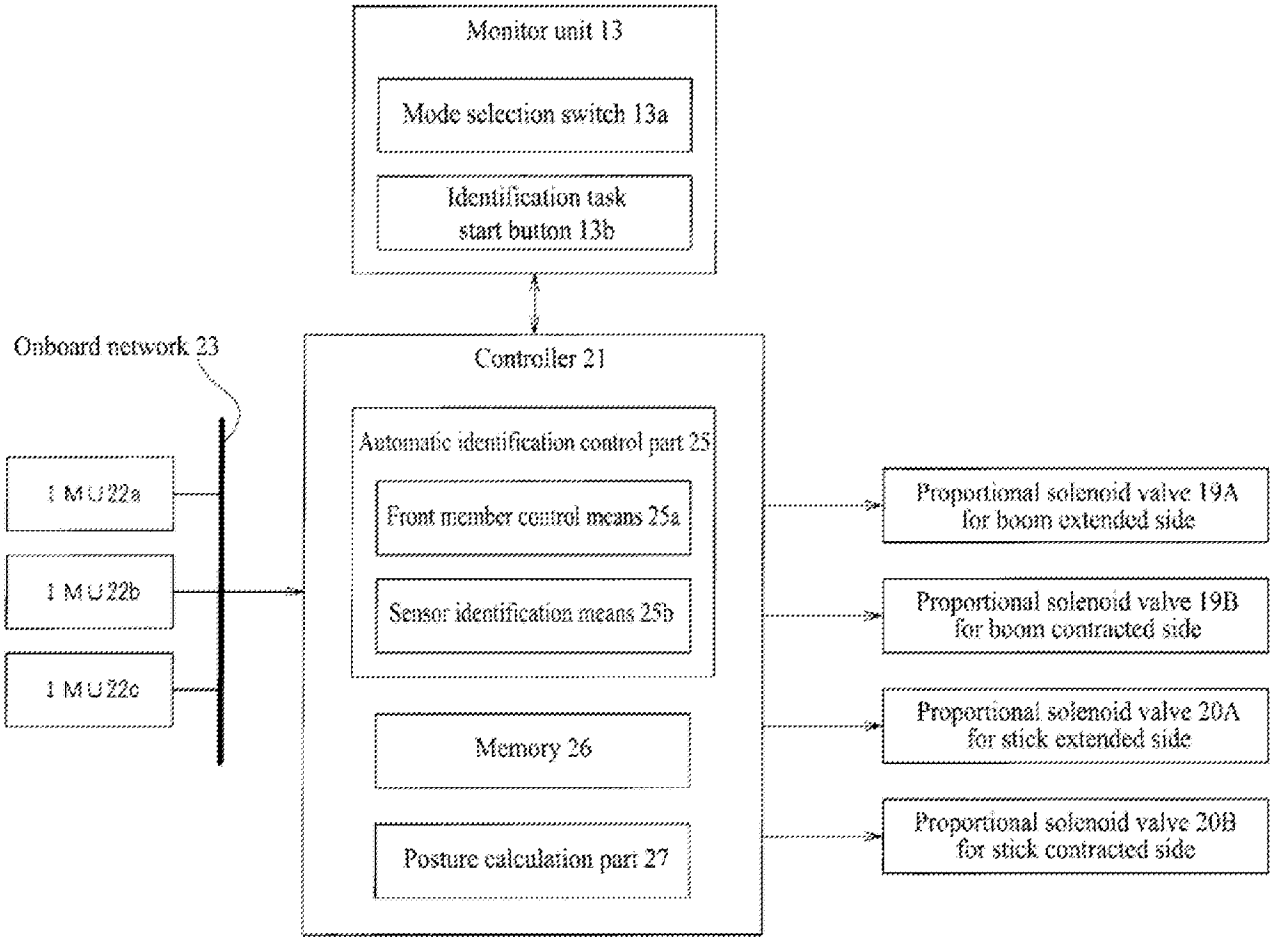
FIG. 3 is a structure block diagram of controller related to IMU and automatic identification system.
Figure 4:
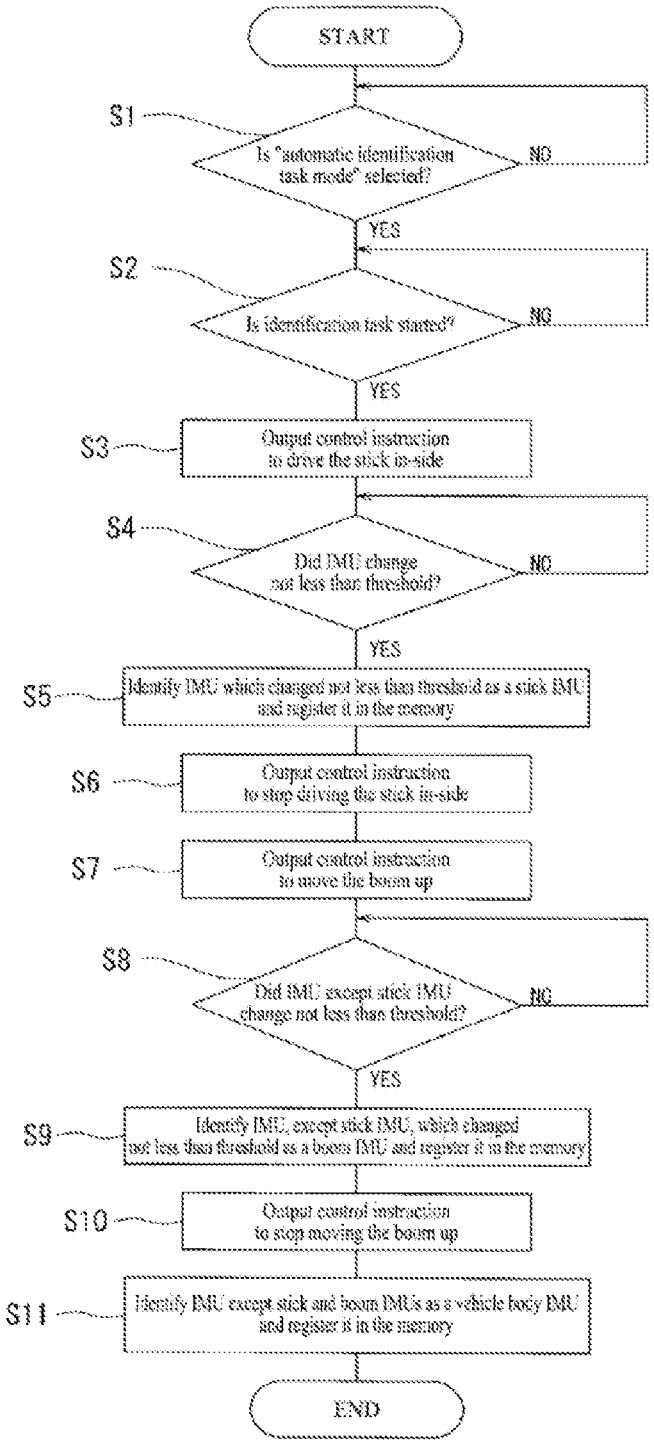
FIG. 4 is a flow chart diagram indicative of a control of automatic identification task control part.

As shown in the structure block diagram in FIG. 3, an input side of the controller 21 is connected to the IMUs 22*a* to 22*c* via the onboard network 23 and an output side of it is connected to the proportional solenoid valves 19A, 19B, 20A, and 20B for boom/stick extended side and contracted side, and further the monitor unit 13 is I/O connected to the controller 21; the controller 21 is equipped with automatic identification control part 25 for controlling automatic identification task of IMU 22, a memory 26 for storing a correspondence between IMUs 22*a* to 22*c* identified in the automatic identification task and mounting members 6, 5, and 3, a posture calculation part 27 for calculating the posture of hydraulic excavator 1 based on the detection signal from IMUs 22*a* to 22*c*, and others; and the automatic identification control part 25 further has front member control means 25*a* and sensor identification means 25*b*.

The automatic identification task performed based on the control of the automatic identification control part 25 is to identify which one of IMU 22 is mounted on which one of mounting members 6, 5, and 3; the automatic identification task is performed when the correspondence between IMU 22 and mounting members 6, 5, and 3 is not stored in the memory 26 such as when one of IMU 22 is mounted newly on the hydraulic excavator 1, when the correspondence already stored in memory 26 is requested to be updated such as when replacing IMU 22, and others; and in this embodiment, the automatic identification task is configured to be started based on the operation of the monitor unit 13.

As mentioned above, the monitor unit 13 is arranged in the cab 11 and is able to display various images and various types of body information on a screen and configure various settings; but this unit has various operation means operable by operator such as a touch operation part shown in a screen and an operation key or button arranged adjacent to the screen; as an operation means of the monitor unit 13, a mode selection switch 13*a* and identification task start button 13*b* mentioned later and used for automatic identification task are provided, and in the screen of the monitor unit 13, the progress and result of automatic identification task are displayed with figures and characters. Note that the mode selection switch 13*a* and identification task start button 13*b* are equivalent to the mode selection means and task starting means of this invention.

Next, an explanation will be given about a control of automatic identification task performed by the automatic identification control part 25 based on the flow chart diagram in FIG. 4. First of all, the controller 21 (automatic identification control part 25) judges whether the "automatic identification task mode" is selected (step S1). The "automatic identification task mode" is selected when an operator operates the mode selection switch 13*a* provided on the monitor unit 13, but in this embodiment, a service screen is displayed on the screen of the monitor unit 13 so that various modes can be selected and the "automatic identification task mode" can be selected from these various modes with the mode selection switch 13*a*. Also, an automatic identification task is possible only when the "automatic identification task mode" is selected.

If the judgment is "YES" in the step S1, that is, if "automatic identification task mode" is selected, it is further judged whether an operation to start the identification task is performed (step S2). In this embodiment, the operation to start the identification task is to be performed when the operator pushes the identification task start button 13*b* provided on the monitor unit 13.

If the judgment is "NO" in the step S1, that is, if "automatic identification task mode" is not selected, the flow goes back to the judgment in step S1. Also, if the judgment is "NO" in step S2, that is, if the operation to start the identification task is not performed, the flow goes back to the judgment in the step S2.

Meanwhile, if the judgment is "YES" in the step S2, that is, if the operation to start the identification task is performed (identification task start button 13*b* is pushed), the controller 21 outputs the control instruction to drive the stick 6 alone in-side (step S3). In particular, the control instruction to output a pilot pressure to proportional solenoid valve 20A for stick extended side is output by the controller 21, thus the stick control valve 18 is switched to extended operating position X to extend a stick cylinder 9, thereby driving the stick 6 in-side.

Then, the controller 21 judges whether there is any one of IMU 22 where the detection value changes not less than preset threshold, among a plurality of IMU 22 into which a detection value is input (step S4). This judgment in step S4 continues until the change of detection value in any one of IMU 22 will be greater than or equal to the threshold.

If the judgment is "YES" in the step S4, that is, if there is any one of IMU 22 where the detection value changed not less than preset threshold, the one of IMU 22 is identified to be the stick IMU 22*a* mounted on the stick 6, and a correspondence between the individual identification number of the stick IMU 22*a* and the estick 6 is registered and stored in memory 26 (step S5). That is to say, when the stick 6 is driven alone in the operation in step S3, the detection value of IMU 22*a* mounted on the stick 6 should change and the detection value of IMU 22 mounted on the boom 5 and upper swiveling body 3 should not change, so IMU 22*a* with changed detection value is identifiable to be stick IMU 22*a*; in this case, a case of misjudgment where the detection value changed a little due to a vibration and others can be excluded by setting the change to not less than the threshold.

After the operation in the step S5 ended, the controller 21 outputs the control instruction to stop driving the stick 6 in-side (step S6). In particular, the controller stops the control instruction to output the pilot pressure to proportional solenoid valve 20A for stick extended side, thus the stick control valve 18 is returned to neutral position N to stop the stick cylinder 9, thereby stopping driving the stick 6.

After the operation in the step S6 ended, the controller 21 further outputs the control instruction to drive the boom 5 alone (step S7). In particular, the control instruction to output the pilot pressure to proportional solenoid valve 19A for boom extended side is output by the controller 21, thus the boom control valve 17 is switched to extended operating position X to extend the boom cylinder 8, thereby moving the boom 5 up.

Then, the controller 21 judges whether there is any one of IMU 22 except the stick IMU 22*a* where the detection value changes not less than preset threshold, among a plurality of IMU 22 into which a detection value is input (step S8). This judgment in step S8 continues until the change of the detection value in any one of IMU 22 except stick IMU 22*a* will be greater than or equal to the threshold.

If the judgment is "YES" in the step S8, that is, if there is any one of IMU 22 except stick IMU 22*a* where the detection value changed not less than preset threshold, the one of IMU 22 is identified to be a boom IMU 22*b* mounted on the boom 5, and a correspondence between the individual identification number of the boom IMU 22*b* and the boom 5 is registered and stored in memory 26 (step S9). That is to say, when the boom 5 is driven alone in the operation in step S7, the detection value of IMU 22*b* mounted on the boom 5 and IMU 22*a* mounted on the stick 6 coupled with the end part of boom 5 should change and the detection value of IMU 22*c* mounted on the upper swiveling body 3 should not change, so IMU 22*b* with changed detection value except stick IMU 22*a* is identifiable to be boom IMU 22*b*; in this case, similar to stick IMU 22*a*, a case of misjudgment where the detection value is changed a little due to a vibration and others can be excluded by setting the change to not less than the threshold.

After the operation in the step S9 ended, the controller 21 outputs the control instruction to stop driving the boom 5 (step S10). In particular, the controller stops the control instruction to output the pilot pressure to proportional solenoid valve 19A for boom extended side, thus the boom control valve 17 is returned to neutral position N to stop the boom cylinder 8, thereby stopping driving the boom 5.

After the operation in the step S10 ended, the controller 21 identifies IMU 22*c* except stick IMU 22*a* and boom IMU 22*b* identified respectively in the steps S5 and S9 as vehicle body IMU 22*c* mounted on the upper swiveling body 3, and a correspondence between the individual identification number of the vehicle body IMU 22*c* and the upper swiveling body 3 is registered and stored in memory 26 (step S10). Thus, all IMU 22*a* to 22*c* are identified as being mounted on any one of mounting members (stick 6, boom 5, and upper swiveling body 3) and the automatic identification task ends.

In addition, in the control performed by the automatic identification control part 25, the control in steps S3, S6, S7, and S10 is performed by front member control means 25*a* provided in the automatic identification control part 25, and the control in steps S4, S5, S8, S9, and S11 is performed by sensor identification means 25*b* provided in the automatic identification control part 25.

Also, the operation to start the identification task, that is, the operator's operation who pushes the identification task start button 13*b*, is equivalent to the step to operate the task starting means for starting the identification task of this invention; the steps S3, S6, S7, and S10 are equivalent to the step to output the control instruction from front member control means of this invention to front member driving means to drive and stop multiple front members sequentially, individually, and automatically; the steps S4, S5, S8, and S9 are equivalent to the step to identify the posture information detection sensor mounted on each front member based on changes of the detection value from posture information detection sensor as the each front member is driven by the front member control means.

The correspondence between respective IMUs 22*a* to 22*c* and mounting members 6, 5, and 3 registered in the memory 26 is used when calculating the posture of the stick 6, boom 5, and upper swiveling body 3 in the posture calculation part 27. That is to say, the posture calculation part 27 identifies which detection signal is output from which IMU 22*a*, 22*b*, or 22*c* mounted on which one of mounting members 6, 5, or 3 based on the fixed identification number added to the detection signal input from IMUs 22*a* to 22*c* and the correspondence stored in the memory 26. Then, the posture calculation part 27 calculates the posture of mounting members 6, 5, and 3 where the IMUs 22*a* to 22*c* are mounted based on the measured value of IMUs 22*a* to 22*c*. For example, in this embodiment, a tilt angle of stick 6 is calculated according to the measured value of stick IMU 22*a* mounted on the stick 6, the tilt angle of boom 5 is calculated based on the measured value of boom IMU 22*b* mounted on the boom 5, and the tilt angle of upper swiveling body 3 is calculated according to vehicle body IMU 22*c* mounted on swiveling frame 3*a* of the upper swiveling body 3. Moreover, the posture calculation part 27 is configured to calculate various postures and positions (tilt of upper swiveling body 3, position of boom 5, stick 6, and bucket 7 in a coordinate system with reference to upper swiveling body 3, and others, for example) of hydraulic excavator 1 based on calculated postures of these mounting members 6, 5, and 3 and various types of data preliminarily input (supporting part's position of boom 5 related to upper swiveling body 3, length between supporting parts of boom 5, stick 6, and bucket 7, and others, for example), display the various types of posture and position information calculated on the monitor unit 13, and output it to various control means (not shown) in order to use it for various automatic controls such as movable range restriction control of front working machine 4.

In this embodiment configured as described above, an articulated front working machine 4 rotatably connecting multiple front members such as the stick 6 and boom 5 is installed on the upper swiveling body 3 as a vehicle body, and IMUs 22*a* to 22*c* as the posture information detection sensor for detecting the posture information are mounted respectively on the stick 6, boom 5, and upper swiveling body 3. And, the posture of stick 6, boom 5, and upper swiveling body 3 is calculated by the controller (control unit) 21 based on the detection signal from these IMUs 22*a* to 22*c*, the calculation result is displayed on the display unit such as monitor unit 13 and used for various automatic controls; an automatic identification system is provided in this controller which performs the identification task to identify which one of IMU 22 is mounted respectively on which one of front members (stick 6, boom 5) when a plurality of IMU 22 is mounted newly; the automatic identification system is configured to have the identification task start button 13*b* (task starting means) for being operated to start the identification task, the front member control means 25*a* for outputting the control instruction to stick and boom driving means (proportional solenoid valves 20A, 19A for stick and boom extended side constituting stick and boom driving means in this embodiment) for driving and stopping the stick 6 and boom 5 sequentially, individually, and automatically, and the sensor identification means 25*b* for identifying IMUs 22*a*, 22*b* mounted on the stick 6 and boom 5 based on changes of the detection value of IMU 22 as the stick 6 and boom 5 are driven by the front member control means 25*a*.

As such, in this embodiment, when performing the identification task to identify which one of IMU 22 is mounted respectively on which one of front members (stick 6, boom 5), if the identification task start button 13*b* is operated to perform the identification task, the control instruction is output from the front member control means 25*a* to the stick and boom driving means to drive and stop the stick 6 and boom 5 sequentially, individually, and automatically so that IMUs 22*a*, 22*b* are identified by the sensor identification means 25*b* based on changes of the detection value of IMU 22 as the stick 6 and boom 5 are driven. In consequence, only when the operator operates the identification task start button 13*b*, the identification task of IMU 22 is automatically performed, the operator does not need to sequentially drive front members, so that a lot of trouble can be reduced, the burden of operator is reduced, and the identification error can be avoided due to the mis-operation of operator.

Additionally, the automatic identification system is provided with a mode selection means (mode selection switch 13*a*) for selecting a mode ("automatic identification task mode") to start up the automatic identification system. Thus, when "automatic identification task mode" is not selected, the automatic identification task is not performed, and unintended startup of automatic identification task can be avoided due to the mis-operation of the task starting means (identification task start button 13*b*).

Note that it is to be understood that this invention is not confined to the embodiment mentioned above; for example, automatic drive and stop processes of multiple front members by front member control means can be configured to go on only when the task progression means is operating. According to the configuration in this manner, the operator can be aware of an ongoing of automatic drive and stop processes of front members even if front members are automatically driven and stopped, and when the operator stops the operation of the task progression means, automatic drive and stop processes of front members are stopped, thereby responding to unexpected incident. In this case, the task progression means is also used as the task starting means. For example, the identification task start button 13*b* as the task starting means of the embodiment mentioned above may be also configured to use as the task progression means; thus, when the identification task start button 13*b* is pushed, the identification task may be started; and, when the identification task start button 13*b* is kept pushed, the automatic drive and stop processes of the front members may continue. In this manner, when the task starting means is also used as the task progression means, members can be used for diverse purposes and the operator can successively perform the startup and progression of identification task with one operation means, being excellent in operability. In addition, the task progression means and task starting means can be provided separately, and another manipulator (operation lever, for example) installed in the construction machine may be configured to be used as the task progression means only during the identification task.

Furthermore, in the embodiment mentioned above, both mode selection means (mode selection switch 13*a*) and task starting means (identification task start button 13*b*) are installed on the monitor unit 13, but without being limited to this, they may be installed in an appropriate place in the cab, for example, in an operation panel where various operation switches are arranged concentratedly.

Also, the posture information detection sensor for detecting the posture information of front members may not be limited to IMU, but for example, may be a tilt angle sensor or gyro sensor.

Furthermore, in this embodiment, the stick and boom are exemplified as the front member where the posture information detection sensor is mounted, but this invention can be exploited in cases: where a work attachment such as the bucket is rotatably installed at the end part of stick, similar to this embodiment, and the posture information detection sensor will be provided on the work attachment; where the boom is installed horizontally swingably on the vehicle body and the posture information detection sensor will be provided on the horizontally swingable boom; or where the posture information detection sensor will be provided on various front members constituting articulated working machine installed on the construction machine except hydraulic excavator.

INDUSTRIAL APPLICABILITY

The present invention can be used when mounting the multiple posture information detection sensors on the construction machine such as the hydraulic excavator.

The invention claimed is:

1. An automatic sensor identification system in a construction machine, wherein the construction machine is provided with an articulated working machine installed on a vehicle body and configured by rotatably connecting multiple front members, a front member driving means for driving each of said multiple front members, multiple posture information detection sensors mounted on said multiple front members respectively for detecting posture information of said front members, and a control unit configured to calculate a posture of front members based on detection signals from the posture information detection sensors; and wherein, when providing the automatic sensor identification system for performing an identification task to identify which one of said multiple posture information detection sensors is mounted respectively on which front member, the automatic sensor identification system comprises:

a task starting means operated for starting the identification task, a front member control means for outputting a control instruction to said front member driving means to drive and stop said multiple front members sequentially, individually, and automatically in response to the task starting means being operated for starting the identification task, wherein automatic drive and stop processes of the multiple front members by the front member control means go on only when a task progression means is operating, and when the operation of the task progression means is stopped, the automatic drive and stop processes of the multiple front members are stopped, wherein the task progression means is also used as the task starting means, and a sensor identification means for identifying the posture information detection sensor mounted on each front member based on changes of a detection value from the posture information detection sensor as said each front member is driven by the front member control means; and upon identifying each posture information detection sensor, the control unit stores a correspondence between an identifier number of each sensor and its associated front member in memory.

2. The automatic sensor identification system in the construction machine of claim 1, wherein the automatic sensor identification system has a mode selection means for selecting a mode to start up the automatic sensor identification system.

3. An automatic sensor identification method in a construction machine to identify which one of multiple posture information detection sensors is mounted respectively on which front member, wherein the construction machine is provided with an articulated working machine installed on a vehicle body and configured by rotatably connecting multiple front members, a front member driving means for driving each of said multiple front members, the multiple posture information detection sensors mounted on said multiple front members respectively for detecting posture information of said front members, and a control unit calculating a posture of the front members based on detection signals from the posture information detection sensors; and wherein the automatic sensor identification method comprises:

operating a task starting means for starting an identification task, outputting the control instruction from a front member control means to said front member driving means to drive and stop the multiple front members sequentially, individually, and automatically in response to the task starting means being operated for starting the identification task, wherein automatic drive and stop processes of the multiple front members by the front member control means go on only when a task progression means is operating, and when the operation of the task progression means is stopped, the automatic drive and stop processes of the multiple front members are stopped, wherein the task progression means is also used as the task starting means, and identifying the posture information detection sensor mounted on each front member based on changes of a detection value from the posture information detection sensor as said each front member is driven by the front member control means; and storing, via the control unit upon identifying each posture information detection sensor, a correspondence between an identifier number of each sensor and its associated front member in memory.

4. An automatic sensor identification method in a construction machine to identify which one of multiple posture information detection sensors is mounted respectively on which a stick, a boom and an upper swinging body of the construction machine, wherein the construction machine is provided with an articulated working machine installed on a vehicle body and including the stick, the boom and the upper swinging body, a stick driving means for driving the stick, a boom driving means for driving the boom and a body driving means for driving the upper swinging body, each of the stick, the boom and the upper swinging body having a corresponding one of the multiple posture information detection sensors mounted thereon for detecting posture information of the stick, the boom and the upper swinging body, and a control unit calculating postures of the stick, the boom and the upper swinging body based on detection signals from the posture information detection sensors; and wherein the automatic sensor identification method comprises:

operating an identification task start button for starting an identification task, outputting control instructions from a controller of the construction machine to the stick driving means, the boom driving means and the body driving means to drive and stop the stick, the boom and the upper swinging body sequentially, individually, and automatically in response to the identification task start button being operated for starting the identification task, wherein automatic drive and stop processes of the stick, the boom and the upper swinging body by the controller go on only when the identification task start button is operating, and when the operation of the task progression means is stopped, the automatic drive and stop processes of the multiple front members are stopped, wherein the task progression means is also used as the task starting means, and identifying the posture information detection sensor mounted on each of the stick, the boom and the upper swinging body based on changes of a detection value from the posture information detection sensor as each of the stick, the boom and the upper swinging body is driven by the stick control means, the boom control means and the body control means, respectively and storing, via the control unit upon identifying each posture information detection sensor, a correspondence between an identifier number of each sensor and its associated front member in memory.

* * * * *